US006287134B1

(12) United States Patent
Liao

(10) Patent No.: US 6,287,134 B1
(45) Date of Patent: Sep. 11, 2001

(54) PROCESSOR-REMOVING TOOL FOR REMOVING A PROCESSOR FROM A RIGHT ANGLE CONNECTOR

(75) Inventor: Hung-Ta Liao, Taipei (TW)

(73) Assignee: Mitac International Corp., Hsin-Chu (TW)

( * ) Notice: Subject to any disclaimer, the term of this patent is extended or adjusted under 35 U.S.C. 154(b) by 0 days.

(21) Appl. No.: 09/614,564

(22) Filed: Jul. 12, 2000

(51) Int. Cl.[7] ..... H01R 13/62
(52) U.S. Cl. ..... 439/160; 439/162; 439/686
(58) Field of Search ..... 439/162, 59, 160, 439/155, 72, 73, 325, 331, 333, 923, 940, 571, 686; 29/762, 764, 770

(56) References Cited

U.S. PATENT DOCUMENTS 5,801,926 * 9/1998 Cutsforth et al. ..... 361/754
5,906,497 * 5/1999 Pham et al. ..... 439/160

* cited by examiner

*Primary Examiner*—Brian Sircus
*Assistant Examiner*—Chandrika Prasad
(74) *Attorney, Agent, or Firm*—Winston Hsu

(57) ABSTRACT

The present invention provides a processor-removing tool for removing an Intel Slot 1 processor from a right angle Slot 1 connector. The Slot 1 connector is installed on a horizontally oriented motherboard over which the processor can be horizontally inserted into or removed from the Slot 1 connector. When the processor is horizontally inserted into the connector, two vertical gaps are present between the left and right sides of the processor and the corresponding two sides of the connector. The tool comprises a shaft, two supporting poles installed at two sides of the shaft, and two rods installed at a front end of the two supporting poles. When horizontally removing the processor from the connector, the two rods of the tool are inserted into the two vertical gaps and the shaft of the tool can be pressed to move the left and right sides of the processor backward in the same time so that the processor can be horizontally ejected from the connector.

4 Claims, 6 Drawing Sheets

PROCESSOR-REMOVING TOOL FOR REMOVING A PROCESSOR FROM A RIGHT ANGLE CONNECTOR

BACKGROUND OF THE INVENTION

1. Field of the Invention

The invention relates to a processor-removing tool, and more particularly, to a processor-removing tool for removing an Intel Slot 1 processor from a right angle Slot 1 connector.

2. Description of the Prior Art

There are two types of Intel Slot 1 connectors which can be installed on a horizontally oriented motherboard, one is straight angle Slot 1 connectors, and the other is right angle Slot 1 connectors. A straight angle Slot 1 connectors requires an Intel Slot 1 processor to be inserted into it vertically, and a right angle Slot 1 connector requires the processor to be inserted horizontally. Removal of the processor from the straight angle connector can be done with little difficulty as the processor is directly accessible and can be slid out from above; however, removal of the processor from the right angle connector can be problematic as it is removed horizontally and is frequently inaccessible in this manner due to limited space.

Please refer to FIG. 1. FIG. 1 is a perspective diagram of an Intel Slot 1 processor 12 installed horizontally on a motherboard 10 through a right angle Slot 1 connector 14. The processor 12 and the connector 14 are tightly connected in a crowded area with many delicate electronic components on the motherboard 10. The horizontal removal of the processor 12 from the connector 14 is thus extremely difficult. Moreover, excessive force applied during the removal may cause severe damage to the electronic components on the motherboard 10 through accidental contact.

SUMMARY OF THE INVENTION

It is therefore a primary objective of the present invention to provide a processor-removing tool capable of removing an Intel Slot 1 processor from a right angle Slot 1 connector safely and easily to solve the above mentioned problem.

Briefly, in a preferred embodiment, the present invention provides a processor-removing tool for removing an Intel Slot 1 processor from a right angle Slot 1 connector, the Slot 1 connector being installed on a horizontally oriented motherboard over which the processor can be horizontally inserted into or removed from the Slot 1 connector, and when the processor is horizontally inserted into the connector, two vertical gaps are present between the left and right sides of the processor and the corresponding two sides of the connector, the tool comprising:

a shaft;

two supporting poles installed at two sides of the shaft; and two rods installed at a front end of the two supporting poles;

wherein when horizontally removing the processor from the connector, the two rods of the tool are inserted into the two vertical gaps and the shaft of the tool can be pressed to move the left and right sides of the processor backward in the same time so that the processor can be horizontally ejected from the connector.

It is an advantage of the present invention that this processor-removing tool can be used to remove an Intel Slot 1 processor from a right angle Slot 1 connector safely and easily.

These and other objectives and advantages of the present invention will no doubt become obvious to those of ordinary skill in the art after having read the following detailed description of the preferred embodiment that is illustrated in the various figures and drawings.

DETAILED DESCRIPTION OF THE PREFERRED EMBODIMENT

Figure 2:
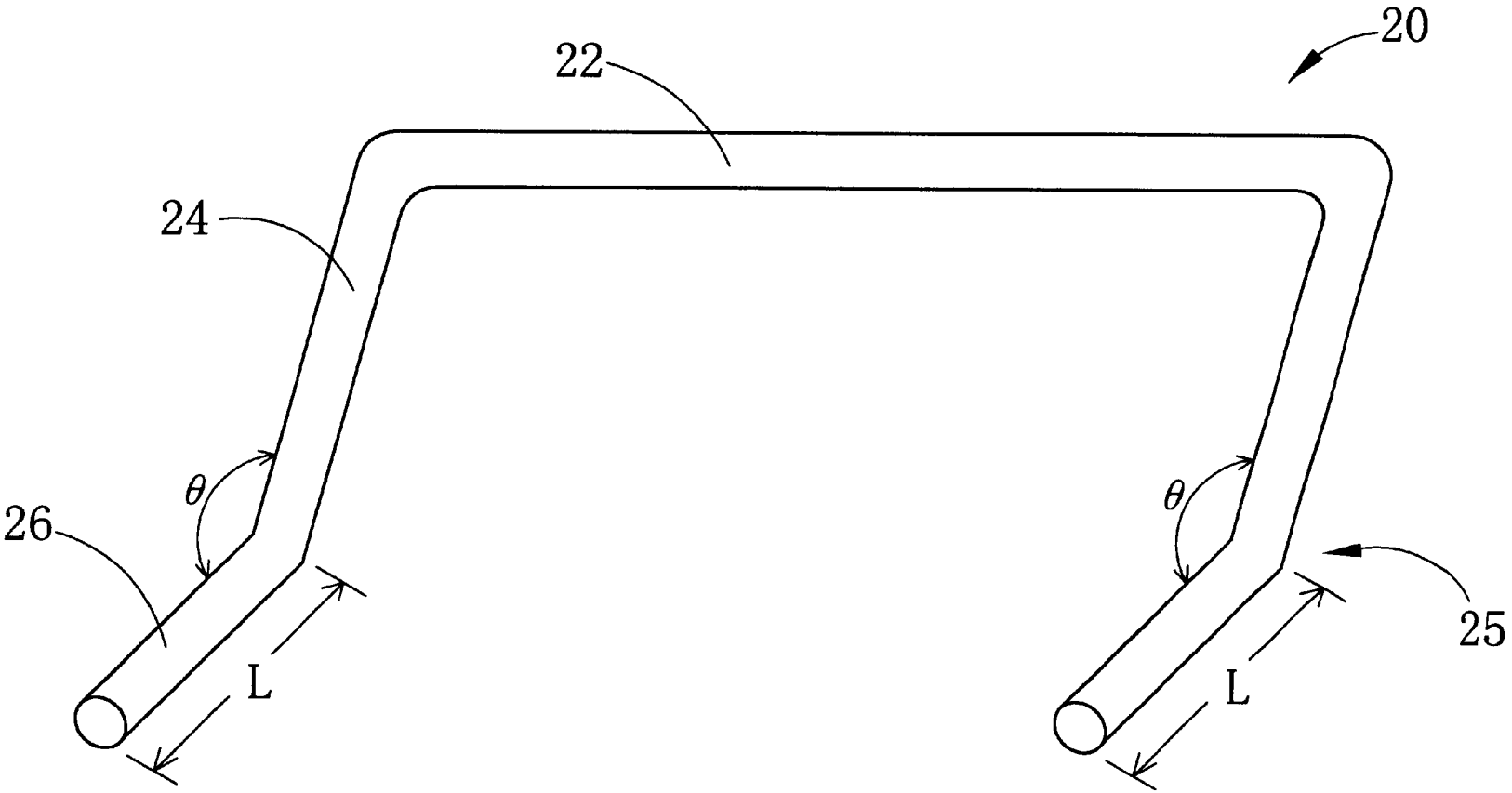
FIG. 2 is a perspective diagram of a processor-removing tool according to the present invention.

Please refer to FIG. 2. FIG. 2 is a perspective diagram of a processor-removing tool 20 according to the present invention. The processor-removing tool 20 comprises a shaft 22, two supporting poles 24 installed at two sides of the shaft 22, and two rods 26 installed at a front end of the two supporting poles 24. The two rods 26 have the same length L and angle, and each rod 26 and its corresponding supporting pole 24 form an angle O between 140° to 170°.

Figure 1:
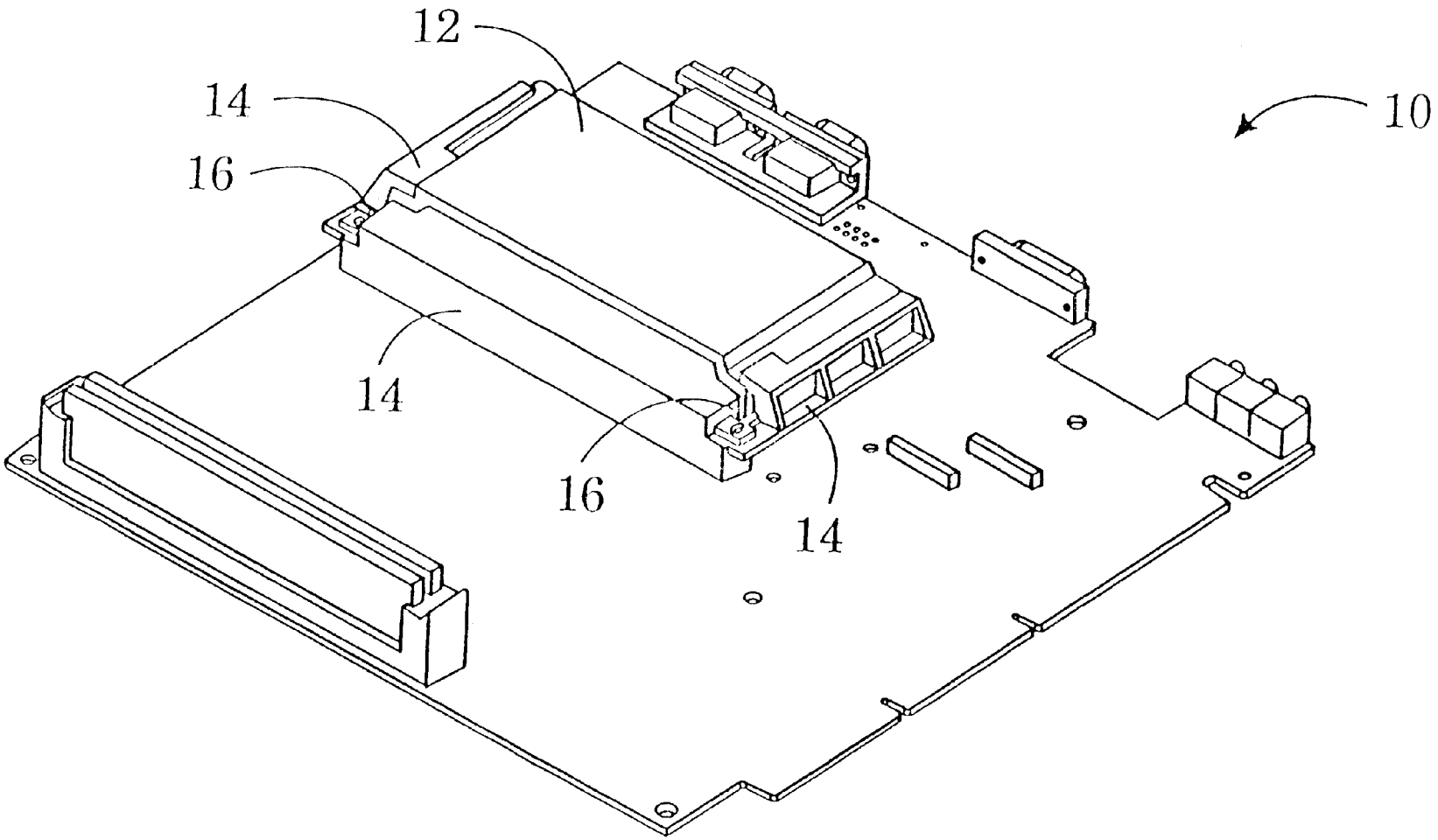
FIG. 1 is a perspective diagram of an Intel Slot 1 Processor installed on the motherboard.
Figure 3:
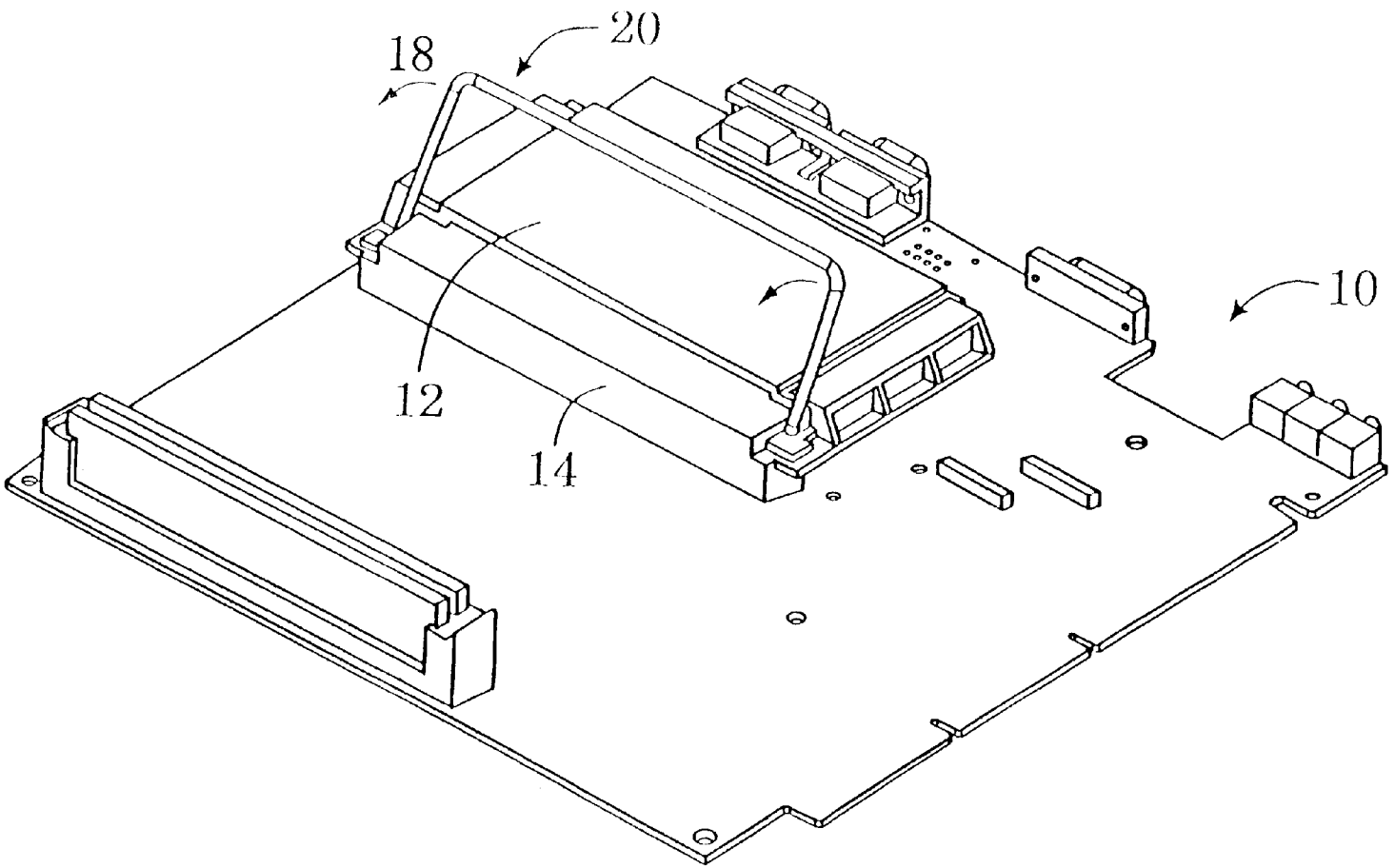
FIG. 3 is a perspective diagram of removing a processor by using the processor-removing tool shown in FIG. 2.
Figure 4:
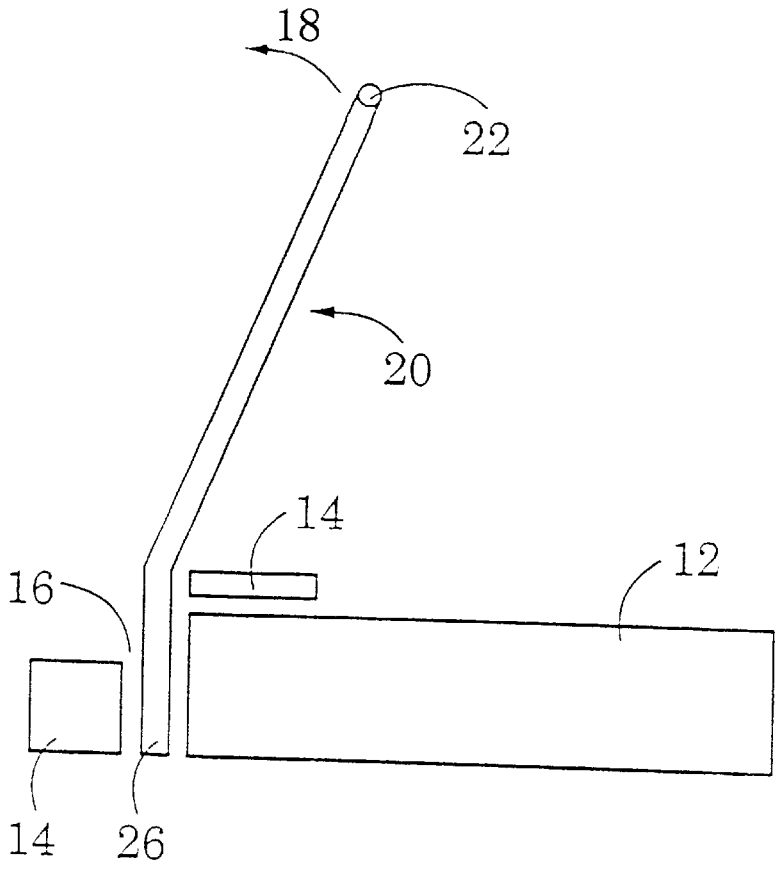
FIG. 4 is a sketching diagram of using the processor-removing tool shown in FIG. 3.
Figure 6:
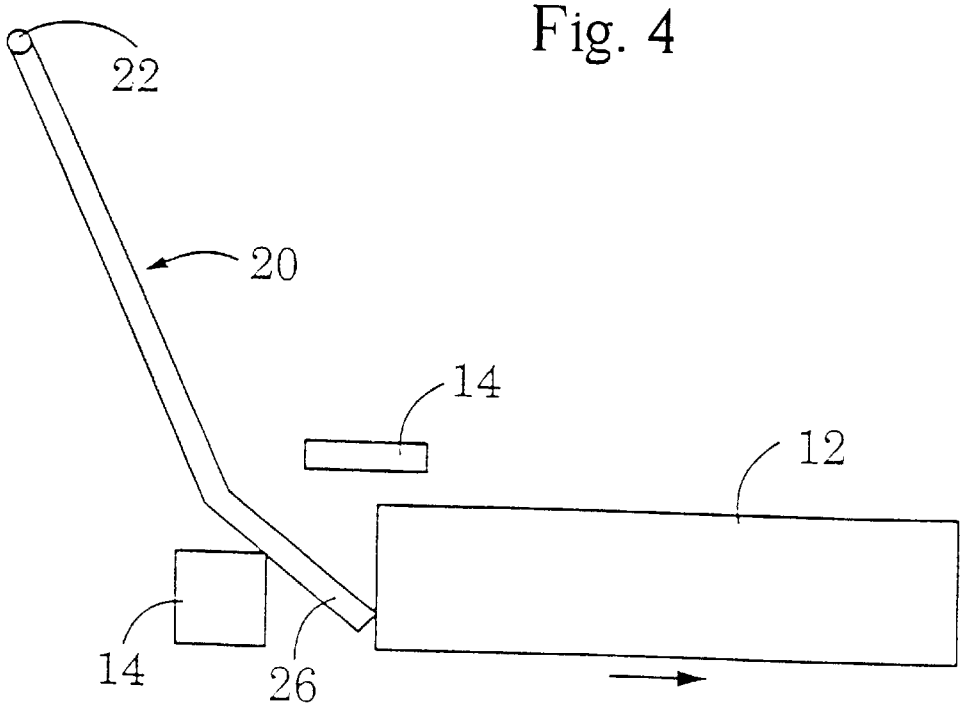
FIG. 6 is a sketching diagram of the processor shown in FIG. 5 when ejected.
Figure 5:
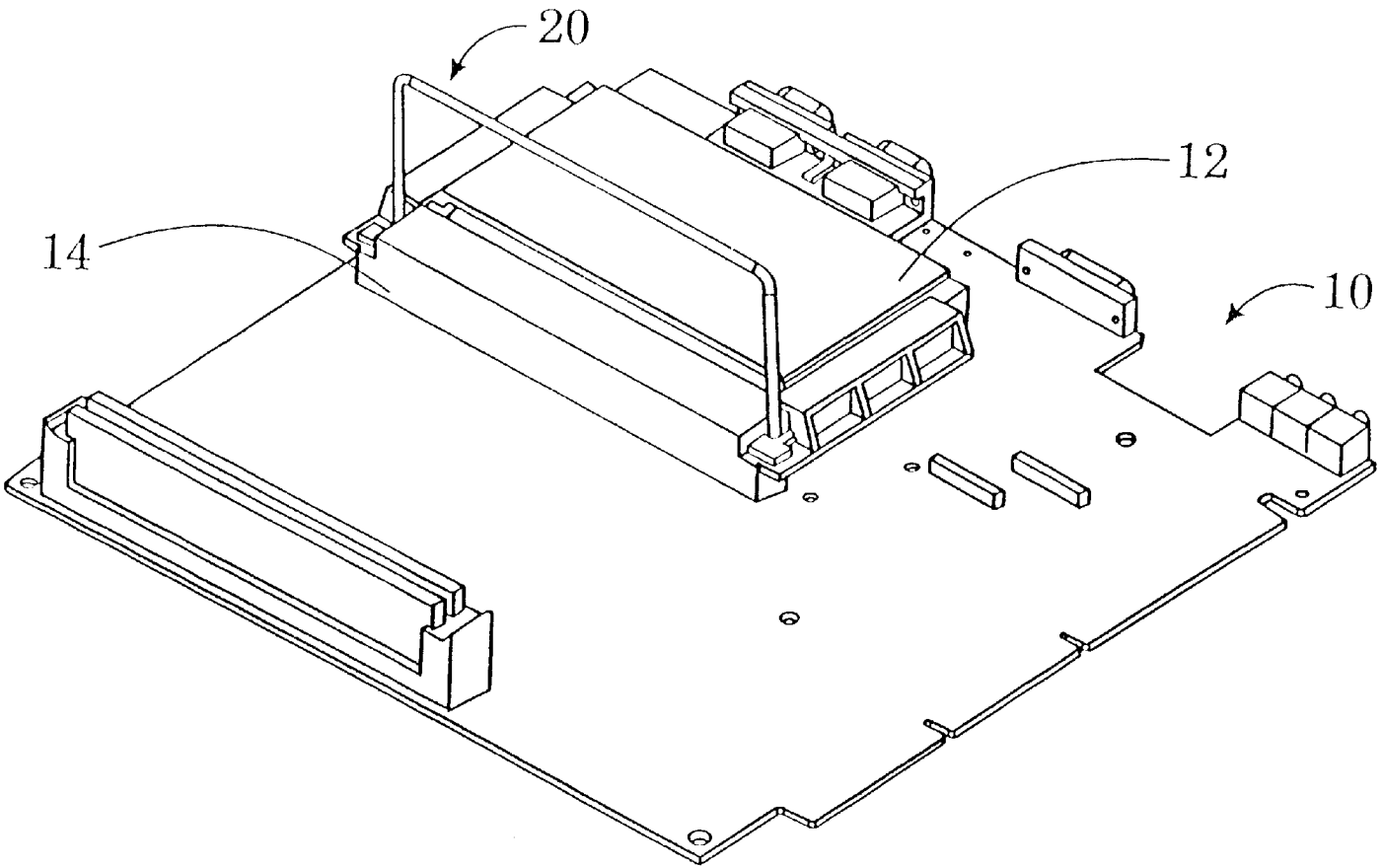
FIG. 5 is a perspective diagram of the processor shown in FIG. 3 when ejected.

Please refer to FIG. 1 and FIGS. 3 to 6. FIG. 3 is a perspective diagram of removing an Intel slot processor 12 from an Intel slot/connector by using the processor-removing tool 20 shown in FIG. 2. FIG. 4 is a sketching diagram of using the processor-removing tool 20 shown in FIG. 3. FIG. 5 is a perspective diagram of the processor 12 shown in FIG. 3 when ejected. FIG. 6 is a sketching diagram of the processor 12 shown in FIG. 5 when ejected. As shown in FIG. 1, when the processor 12 is horizontally inserted into the connector 14, two vertical gaps 16 are present between the left and right sides of the processor 12 and the corresponding two sides of the connector 14. When horizontally removing the processor 12 from the connector 14, the two rods 26 of the tool 20 are inserted into the two vertical gaps 16 and the shaft 22 of the tool 20 is pushed in the direction indicated by arrows 18 in FIG.3 and FIG.4. This causes both the left and right sides of the processor 12 to move backwards thus causing horizontal ejection of the processor 12 from the connector 14.

Figure 7:
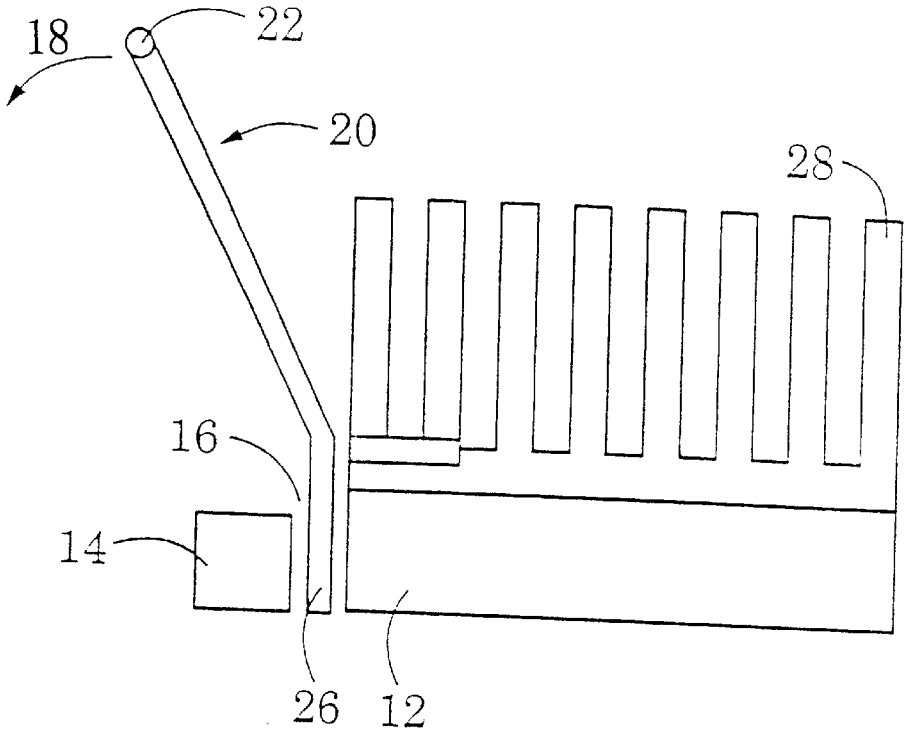
FIGS. 7 and 8 are sketching diagrams of another usage of the processor-removing tool according to the present invention.
Figure 8:
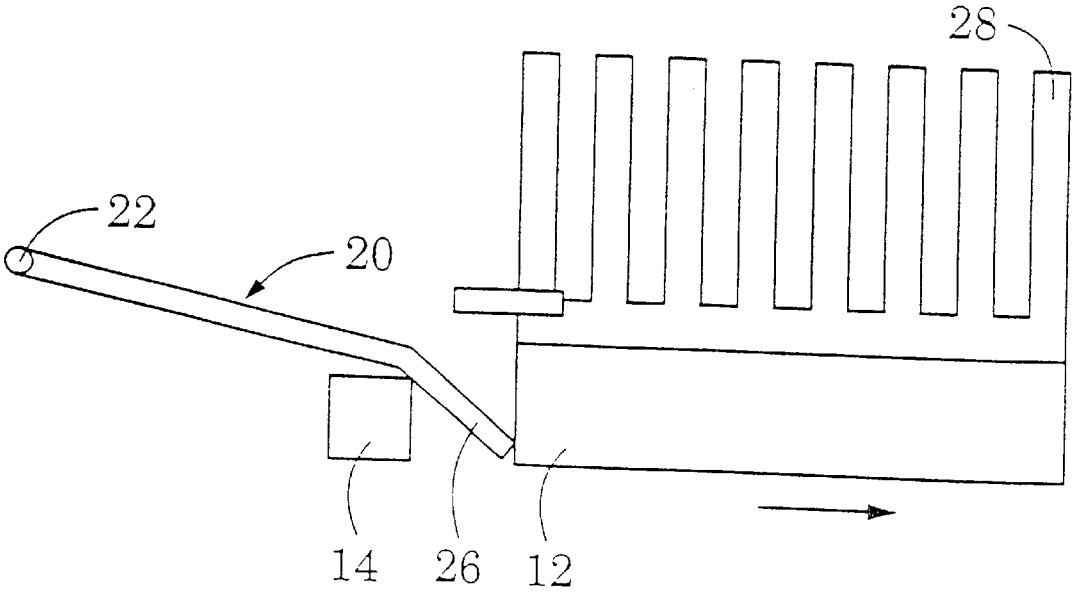

Please refer to FIG. 7 and FIG. 8. FIG. 7 an d FIG. 8 are sketching diagrams of another usage of the processor-removing tool 20 according to the present invention. As seen in the figures, when a heat-dissipating device 28 is installed on the processor 12, the processor 12 can be easily removed horizontally by simply turning the tool 20 around and using it as above in a reverse orientation.

The processor-removing tool 20 of the present invention takes advantage of the two vertical gaps 16 between the left and right sides of the processor 12 and the corresponding two sides of the connector 14. The tool 20 is inserted into these gaps 16 to remove the processor 12 horizontally so that components present on the motherboard are not affected or damaged by this process. Furthermore, the processor-removing tool 20 can be used even if other components are installed on the processor 12. It is capable of removing an Intel Slot 1 processor from a right angle Slot 1 connector safely and easily thus making it cost effective and practical.

Those skilled in the art will readily observe that numerous modifications and alterations of the propeller may be made while retaining the teachings of the invention. Accordingly, the above disclosure should be construed as limited only by the metes and bounds of the appended claims.

What is claimed is:

1. A processor-removing tool for removing a processor from a right angle connector, the connector being installed on a horizontally oriented motherboard over which the processor can be horizontally inserted into or removed from the connector, and when the processor is horizontally inserted into the connector, two vertical gaps are present between the left and right sides of the processor and the corresponding two sides of the connector, the tool comprising:

a shaft;

two supporting poles installed at two sides of the shaft; and two rods installed at a front end of the two supporting poles;

wherein when horizontally removing the processor from the connector, the two rods of the tool are inserted into the two vertical gaps and the shaft of the tool can be pressed to move the left and right sides of the processor backward in the same time so that the processor can be horizontally ejected from the connector.

2. The processor-removing tool of claim 1 wherein each rod and its corresponding supporting pole form an angle which is less than 180°.

3. The processor-removing tool of claim 2 wherein each rod and its corresponding supporting pole form an angle between 140° to 170°.

4. The processor-removing tool of claim 2 wherein the two rods have the same length and angle.

* * * * *